United States Patent [19]

Howell et al.

[11] 4,220,485

[45] Sep. 2, 1980

[54] PROCESS FOR SEALING PHOSPHATIZED METAL COMPONENTS

[75] Inventors: George D. Howell, Alton; Donald A. Lange, Edwardsville, both of Ill.

[73] Assignee: Calgon Corporation, Pittsburgh, Pa.

[21] Appl. No.: 969,530

[22] Filed: Dec. 14, 1978

[51] Int. Cl.[2] ..... C23F 7/10

[52] U.S. Cl. ..... 148/6.15 Z; 106/14.12; 106/14.15; 106/14.21; 148/6.15 R

[58] Field of Search ..... 106/14.12, 14.21; 148/6.15 R, 6.15 Z

[56] References Cited

U.S. PATENT DOCUMENTS

| | | | |
|---|---|---|---|
| 3,101,286 | 8/1963 | Reinhold | 148/6.15 |
| 3,268,367 | 8/1966 | Nelson | 148/6.15 |
| 3,269,877 | 8/1966 | Schlossberg et al. | 148/6.15 |
| 3,607,453 | 9/1971 | Engesser et al. | 148/6.15 Z |
| 3,764,353 | 10/1973 | Shimizu et al. | 148/6.15 R |
| 4,057,440 | 11/1977 | Atkiss et al. | 148/6.15 Z |
| 4,138,353 | 2/1979 | Lipinski | 106/14.12 |

*Primary Examiner*—Lorenzo B. Hayes

*Attorney, Agent, or Firm*—Mario A. Monaco; Martin L. Katz

[57] ABSTRACT

Process for sealing phosphatized metal components to improve corrosion resistance and paint adhesion which involves coating said components with a zinc-containing sealant.

1 Claim, No Drawings

PROCESS FOR SEALING PHOSPHATIZED METAL COMPONENTS

This invention relates to a composition and method for sealing phosphatized metal components to improve corrosion resistance and paint adhesion.

More particularly, this invention relates to a composition and method for sealing phosphatized metal components with a non-chromic acid based material.

It has been common practice to seal the surface of phosphatized metal components with a chromic acid rinse prior to painting. Hexa-valent chromium is highly toxic and environmental considerations have resulted in a search for a less toxic substitute which provides corrosion protection for the metal components being treated.

Accordingly, it is an object of this invention to provide a less-toxic sealant rinse for phosphatized metal components.

It is a further object of this invention to provide a sealant rinse for phosphatized metal components that increases the coating weight of the phosphate coating and increases paint adhesion.

It is an additional object of this invention to provide a sealant rinse for phosphatized metal components that provides improved corrosion resistance.

It is still a further object of this invention to provide a sealant rinse for phosphatized metal components which may be applied over a wide range of temperatures, i.e. room temperature to 180° F.

These and other objects of this invention are accomplished by the novel composition and method disclosed herein. The composition of the present invention consists essentially of phosphoric acid, a zinc compound(s), a heavy metal accelerator and/or crystal refiner, a phosphonate corrosion inhibitor and sufficient water to dilute the composition to its desired strength.

The components of the composition of the present invention are present in the following amounts:

| Component | Weight Percent | |
|---|---|---|
| | Broad | Preferred |
| Phosphoric Acid | 5 to 80 | 22.5 to 60 |
| Zinc Compound(s) | 1 to 16 | 3 to 12 |
| Heavy Metal Accelerator and/or Crystal Refiner | 0.1 to 10 | 2 to 7 |
| Phosphonate | 1 to 80 | 10 to 30 |

The phosphoric acid component of the composition may be of any suitable grade, however, 75% by weight phosphoric acid is the preferred material. Similarly, while zinc oxide is the preferred form of zinc, any acid-soluble form of the zinc ion, such as the nitrate or chloride, may be used.

Heavy metal accelerators useful in the compositions of the instant invention include compounds of such metals as vanadium, titanium, zirconium, tungsten and molybdenum. The compounds utilized most frequently are the molybdates. In combination with or in place of accelerators, an optional crystal refiner, such as acid-soluble salts of nickel, cobalt, magnesium and calcium, may be utilized in the compositions of the instant invention.

Suitable phosphonates include those of the formula:

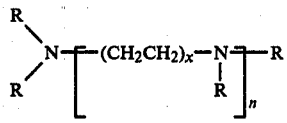

wherein

R is

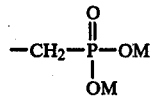

M is H, $NH_4$, alkali metal or combinations thereof;

n is 0 to 6; and x is 1 to 6; and those of the general formula:

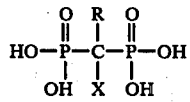

wherein

X is —OH or —$NH_2$ and

R is an alkyl group of from 1 to 5 carbon atoms.

The most preferred compounds, however, are amino tris(methylene phosphonic acid) and hydroxyethylidene-1,1-diphosphonic acid (HEDP) and water-soluble salts thereof.

The zinc sealant rinse composition of the present invention may be applied by conventional immersion or spray processes. Typical processes which may be used include a three-stage process which comprises a cleaning and phosphatizing step, a water rinse step and the zinc sealant rinse step. Better coatings may be obtained by using a five-stage process which comprises an alkaline cleaning step, a water rinse step, a phosphatizing step, an additional water rinse step and the zinc sealant rinse step. The zinc sealant rinse step is carried out at temperatures of from 55° to 180° F. and contact times of from 10 seconds to 2 minutes.

Both the three- and five-stage process may be controlled manually or automatically. Automatic control is, however, preferred because it permits more accurate control of the concentration of the coating compositions, thereby resulting in a more uniform coating on the metal surfaces being treated.

The compositions of the present invention may be prepared by conventional liquid blending techniques and when used in spray or immersion processes, their concentration in water should be at least ¼ oz./gallon of water.

The following examples are representative of the compositions of the present invention:

EXAMPLE 1

| Component | Amount (Weight Percent) |
|---|---|
| Water | 24.5 |
| Zinc Oxide | 7 |
| Sodium Molybdate | 0.5 |
| 75% Phosphoric Acid | 65 |
| 50% Amino tri(methylene-phosphonic acid) | 3 |

EXAMPLE 2

| Component | Amount (Weight Percent) |
|---|---|
| Water | 33 |
| Zinc Oxide | 2 |
| 75% phosphoric Acid | 50 |
| 50% Amino tri(methylene-phosphonic acid) | 10 |
| Ammonium Metavanadate | 5 |

EXAMPLE 3

| Component | Amount (Weight Percent) |
|---|---|
| Water | 20 |
| Zinc Oxide | 5 |
| 75% Phosphoric Acid | 50 |
| 50% Amino tri(methylene-phosphonic acid) | 20 |
| Nickelous Nitrate - $6H_2O$ | 5 |

EXAMPLE 4

| Component | Amount (Weight Percent) |
|---|---|
| Water | 21 |
| Zinc Oxide | 4 |
| 75% Phosphoric Acid | 40 |
| 50% Amino tri(methylene-phosphonic acid) | 30 |
| Calcium Nitrate - $4H_2O$ | 0.5 |
| Sodium Molybdate | 4.5 |

EXAMPLE 5

| Component | Amount (Weight Percent) |
|---|---|
| Water | 17 |
| Zinc Oxide | 1 |
| 75% Phosphoric Acid | 10 |
| 50% Amino tri(methylene-phosphonic acid) | 70 |
| Cobaltous Nitrate - $6H_2O$ | 1 |
| Sodium Molybdate | 1 |

EXAMPLE 6

Metal panels were evaluated in salt tests using a 5% salt spray at 95° F. for 120 hours in accordance with the procedures set forth in ASTM Procedure B117-64 and the panels were evaluated by ASTM Procedure D1654-61 for corrosion creepage from a scratch as well as the degree of body blisters on the test area. The ratings are based on a scale of 1 to 10, with 10 being the best possible rating and 1 being the least. A representative composition of the instant invention was compared to prior art compositions in the results set forth in Table I.

TABLE I

| Panel Description | Water Rinse | 0.05% Chromic Acid | A at 3 oz./gal. | B at 3 oz./gal. | B at 5 oz./gal. | B at 7 oz./gal. |
|---|---|---|---|---|---|---|
| Blister Creepage ASTM D-1654-61 Schedule #1 Rating | ½ to ¾" 1 | ⅛ to ¼" 5 | to ¼" 4 | to 1/16" 7 | to 1/32" 8 | to 1/64" 9 |
| Body Blisters ASTM D-1654-61 Schedule #2 Rating | None 10 | None 10 | None 10 | None 10 | None 10 | None 10 |
| Body Pinhole Rusting | None | None | None | None | None | None |
| Moisture Penetration of Paint | Nil | Nil | Nil | Nil | Nil | Nil |
| Paint Thickness | 1.3 mil | 1.3 mil | 1.3 mil | 1.3 mil | 1.3 mil | 1.3 mil |
| Paint Coverage | Good | Good | Good | Good | Good | Good |

A is a composition consisting of 5% by weight sodium molybdate, 50% by weight of 75% phosphoric acid, 20% by weight of Dequest 2000 [amino tris(methylene phosphonic acid)] and 25% by weight water.
B is a composition consisting of 5% by weight zinc oxide, 5% by weight sodium molybdate, 50% by weight of 75% phosphoric acid, 20% by weight of Dequest 2000 [amino tris(meythylene phosphonic acid)] and 20% by weight water.

The results set forth in Table I demonstrate the improvements obtained when using the compositions of the instant invention.

We claim:

1. A process for sealing phosphatized metal components which comprises coating said components with a composition which consists essentially of:
   (a) from 5 to 80 weight percent phosphoric acid;
   (b) from 1 to 16 weight percent of an acid-soluble zinc compound selected from the group consisting of zinc oxide, zinc nitrite and zinc chloride;
   (c) from 0.1 to 10 weight percent of a heavy metal accelerator selected from the group consisting of vanadium, titanium, zirconium, tungsten and molybdenum compounds and/or crystal refiner selected from the group consisting of an acid-soluble salt of nickel, cobalt, magnesium and calcium;
   (d) from 1 to 80 weight percent of a phosphonate corrosion inhibitor selected from the group of compounds having the formula:

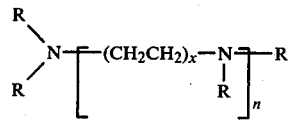

wherein
R is

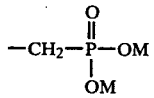

M is H, $NH_4$, alkali metal or combinations thereof;
n is 0 to 6; and
is 1 to 6; and those of the general formula:

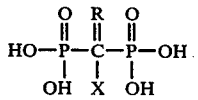

wherein X is —OH or —$NH_2$ and
R is an alkyl group of from 1 to 5 carbon atoms; and
(e) sufficient water to dilute the composition to its desired strength.

* * * * *

UNITED STATES PATENT OFFICE

CERTIFICATE OF CORRECTION

Patent No. 4,220,485 Dated September 2, 1980

Inventor(s) George D. Howell and Donald A. Lange

It is certified that error appears in the above-identified patent and that said Letters Patent are hereby corrected as shown below:

Column 3, Example 6, line 62, after "salt" insert --spray--.

Column 4, Claim 1, line 58, --x-- should be inserted before "is".

Column 4, Claim 1, line 60, the formula should read:

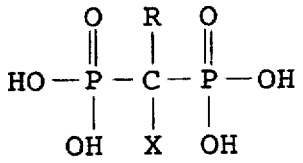

Signed and Sealed this

Second Day of December 1980

[SEAL]

Attest:

SIDNEY A. DIAMOND

Attesting Officer

Commissioner of Patents and Trademarks